US007769192B2

(12) United States Patent
Takagi et al.

(10) Patent No.: US 7,769,192 B2
(45) Date of Patent: Aug. 3, 2010

(54) SPEAKER SYSTEM WITH OSCILLATION DETECTION UNIT

(75) Inventors: Masayuki Takagi, Hamamatsu (JP); Kosuke Takata, Hamamatsu (JP); Yoshihiro Ikegami, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 988 days.

(21) Appl. No.: 11/523,749

(22) Filed: Sep. 19, 2006

(65) Prior Publication Data

US 2007/0076914 A1 Apr. 5, 2007

(30) Foreign Application Priority Data

Sep. 20, 2005 (JP) ..... 2005-272354

(51) Int. Cl.
*H04R 25/00* (2006.01)

(52) U.S. Cl. ..... 381/172; 381/160; 356/135

(58) Field of Classification Search ..... 381/150, 381/111, 160, 172; 356/149–152; 398/134–135
See application file for complete search history.

(56) References Cited

U.S. PATENT DOCUMENTS 3,622,791 A * 11/1971 Bernard ..... 381/172
5,262,884 A * 11/1993 Buchholz ..... 381/172
6,154,551 A * 11/2000 Frenkel ..... 381/172
7,359,523 B2 * 4/2008 Sims ..... 381/172

FOREIGN PATENT DOCUMENTS

| | | |
|---|---|---|
| JP | 59-36687 | 3/1984 |
| JP | 63-16789 | 2/1988 |
| JP | 03-104500 | 5/1991 |
| JP | 04-040199 | 2/1992 |
| JP | 06-284492 | 10/1994 |
| JP | 2003-087892 | 3/2003 |

* cited by examiner

*Primary Examiner*—Suhan Ni
(74) *Attorney, Agent, or Firm*—Foley & Lardner LLP

(57) ABSTRACT

A speaker system comprising a magnetic circuit, a cylindrical shaped voice coil unit generating oscillation in the magnetic circuit, an oscillating plate extending in a circular conical shape from a outer peripheral surface of the voice coil unit, a dust cap connecting to the oscillating plate covering an open face of the voice coil unit on a side surrounded by the oscillating plate, a plurality of linking members connecting to the voice coil unit, and a detection unit. The link members extend toward a center axis of the voice coil unit. The detecting unit further comprises a first component part fastened to the linking members and positioned at the center axis of the voice coil unit closer to the voice coil unit side than the dust cap, and a second component part positioned facing the first component part and is independent of the voice coil unit such that the second component part is held between the first component part and the dust cap. The detecting unit optically detects the oscillations of the voice coil unit by means of a light that courses between the previously mentioned first component part and the second component part.

21 Claims, 3 Drawing Sheets

SPEAKER SYSTEM WITH OSCILLATION DETECTION UNIT

CROSS-REFERENCE TO RELATED PATENT APPLICATIONS

The present invention relates to Japanese patent applications No. 2005-272354 (filed on Sep. 20, 2005), which was assigned to the assignees of the present invention and is incorporated herein by reference in its entirety and from which priority is claimed for the present invention.

BACKGROUND OF THE INVENTION

The present invention relates to a speaker system that detects the oscillation of the voice coil unit with a high degree of accuracy, thus enabling a high fidelity reproduction by the speaker system.

For some time, a detection unit that detects the oscillation displacement of an oscillation system that comprises a voice coil unit, an oscillation plate, and a dust cap has been installed in speaker systems. The detection results by the detection unit are employed in generating a negative feedback through acquiring the difference between the detected oscillation displacement and the input signal. Thus, by compensating the error of the oscillation system (the difference between the detected oscillation and the input signal), a high fidelity reproduction can be achieved. A speaker system that comprises a speaker drive circuit which adjusts the input signal by compensating the error detected by a detection unit is described in Japanese Patent Publication Number 2940587, which is incorporated herein by reference.

With regard to the detection means, Japanese Laid-Open Utility Model Application Publication (Kokai) Number S 63-16789 (FIG. 1) discloses a technology in which the displacement of the oscillation system is detected by affixing a reflecting member to the inner surface of the dust cap, positioning an optical sensor facing the reflecting member, and optically detecting the displacement of the dust cap.

Another example of a detection means is disclosed in Japanese Patent Publication Number 2940587 (paragraph 35, FIG. 1, etc.). In this reference, the displacement of the oscillation system is detected by affixing the reflecting plate not to the inner surface of the dust cap but to the lower edge portion of the voice coil unit, arranging a light sensor directly below the reflecting member, and optically detecting the displacement of the voice coil unit.

However, there are problems associated with affixing the reflecting plate to the inner surface of the dust cap, as disclosed in the first patent reference above. For example, during reproduction, mechanical flexion and sympathetic vibrations are produced in the dust cap. These effects degrade the degree of accuracy of detecting the displacement of the oscillation system.

There are also problems in a system where, as disclosed in the second patent reference above, the reflecting plate is affixed to the lower edge portion of the voice coil unit.

One problem is that the reflecting plate causes a weight distribution imbalance of the voice coil unit with respect to a center axis of the voice coil. The original oscillation action of the voice coil unit without a weight imbalance is a piston motion, in which the voice coil unit oscillates in parallel to the center axis of the voice coil unit. With an imbalance, a rolling oscillation that involves an inclination from the center axis of the voice coil unit is produced. Therefore, the rolling oscillation caused by the weight imbalance degrades the accuracy of the detection of the original oscillation action of the voice coil unit. In addition, because of the rolling oscillation, ideal oscillation is not possible and sound quality becomes relatively degraded as a result.

A second problem is that the voice coil is a source of heat generation. Accordingly, it is necessary to construct the reflecting member, which is attached to the voice coil unit, from heat resistant materials. The construction of the reflecting member with a metal material, which has superior temperature resistant properties, is one option. However, since metal materials are relatively heavy, the use of metal for the reflecting member increases the weight of the voice coil unit. This added weight adversely affects the original oscillation action of the voice coil unit.

The reflecting member may also be constructed from a light-weight resin material, rather than a metal material. The use of a light-weight resin material minimizes the increase in the weight of the voice coil unit. However, when heat resistance properties are taken into consideration, the resin materials that can be used are limited to resins with superior heat resistant properties (for example, engineering plastic). The resins with superior heat resistant properties are relatively high in cost, which increases the manufacturing cost of the overall system.

A third problem is that, because of the limitations in the size of the system, the light sensor is disposed directly below the reflecting member and must be arranged in the vicinity of the voice coil unit. This creates a problem because the characteristics of the light sensor may change or, depending on the circumstances, the light sensor may be destroyed due to the heat generated by the voice coil.

Embodiments of the present invention address the problems discussed above and, in particular, provide a speaker system with which the oscillation of the voice coil unit is detected with a high degree of accuracy and with which high fidelity reproductions are possible.

SUMMARY OF THE DISCLOSURE

A speaker system according to a first preferred embodiment of the present invention comprises a magnetic circuit, a cylindrical shaped voice coil unit generating oscillation in the magnetic circuit, an oscillating plate extending in a circular conical shape from a outer peripheral surface of the voice coil unit, a dust cap connecting to the oscillating plate covering an open face of the voice coil unit on a side surrounded by the oscillating plate, a plurality of linking members connecting to the voice coil unit, and a detection unit. The link members extend toward a center axis of the voice coil unit. The detecting unit further comprises a first component part fastened to the linking members and positioned at the center axis of the voice coil unit closer to the voice coil unit than the dust cap, and a second component part positioned facing the first component part and independent from the voice coil unit such that the first component part is held between the second component part and the dust cap. The detecting unit optically detects the oscillations of the voice coil unit by using a light that courses between the first component part and the second component part.

In a second preferred embodiment, the linking members extend in a radial manner from the first component part toward the voice coil unit and connect the first component part to the voice coil unit.

In a third preferred embodiment, the speaker system further comprises a communicating space that is in communication with an outside space, wherein the communicating space is positioned in an area around the second component part.

In a fourth preferred embodiment, a plurality of heat radiating fins extend in a radial manner from an area around the magnetic circuit. Further, in this embodiment, a plurality of linking arms extend in a radial manner from the second component part toward the heat radiating fins to connect the second component part to the heat radiating fins.

In a fifth preferred embodiment, the first component part comprises either a light sensing unit that has a light emitting element that radiates light and a light receiving element that receives the light radiated from the light emitting element or a reflecting member that reflects the light radiated from the light emitting element toward the light receiving element. The second component part comprises either the light sensing unit or the reflecting member, whichever one is not comprised by the first component part. In this embodiment, the light receiving element is lined up with the light emitting element and receives the light that is radiated from the light emitting element.

In a sixth preferred embodiment, the first component part comprises either one of a light emitting element unit that has a light emitting element radiating a light, or a light receiving element unit that has a light receiving element receiving the light radiated by the light emitting element. Further, in this embodiment, the second component part comprises the other one of either the light emitting element unit or the light receiving element unit, whichever one is not comprised by the first component part.

In a seventh preferred embodiment, the reflecting member comprises a resin molded as a single unit with the linking members. At least a portion of the reflecting member facing the light sensor unit is plated with a mirror surface.

In an eighth preferred embodiment, the reflecting member is made of a resin molded as a single unit with the linking members and is configured with an aluminum reflecting plate that faces the light sensor unit.

In accordance with the speaker system of the first preferred embodiment, the first component part is attached to the voice coil unit through the linking members. Accordingly, the first component part oscillates with the voice coil unit as a single unit. On the other hand, since the second component part is independent of the voice coil unit and positioned facing the first component part, it is possible to detect the oscillation of the voice coil unit by using a light that course between the first component part and the second component part without the light being affected by the deflection or the sympathetic oscillation of the dust cap.

In addition, even though the first component part is attached to the voice coil unit, since the first component part and the second component part are positioned along the center axis of the voice coil unit, the imbalance in the weight distribution of the voice coil unit with respect to the center axis of the voice coil unit is minimized. Therefore, the occurrence of rolling and the degradation of sound quality is reduced and it is possible to detect the piston motion, the original oscillating action of the voice coil unit, with a relatively high degree of accuracy.

In this manner, since the oscillation and displacement of the oscillation system (comprising the voice coil unit, the oscillating plate, and the dust cap) are detected, it is possible to detect the oscillation of the voice coil unit (the source of the oscillation of the oscillation system) with a high degree of accuracy. Hence, there is the advantageous result that a high fidelity reproduction can be achieved.

In accordance with the speaker system of a second preferred embodiment, the first component part and the voice coil unit are attached through the linking members that extend in a radiating manner. Accordingly, in addition to the advantages of the speaker system of the first embodiment, there is the advantageous result that it is possible to better control the occurrence of the imbalance in the weight distribution of the voice coil unit with respect to the center axis of the voice coil unit. In addition, the air permeability of the periphery of the first component part is maintained due to the spaces between the linking members. Hence, there is the advantageous result that it is possible to eliminate the design burden of taking into account the heat resistance of the first component part from the heat generated by the voice coil unit. Furthermore, since the linking members can be made relatively lighter in weight, there is the advantageous result that it is possible to minimize changes to the original oscillating action of the voice coil unit and therefore minimize changes to the audio characteristics due to the weight of the linking members.

In accordance with the speaker system of a third preferred embodiment, the speaker system comprises a linking space that links to the outside around the periphery of the second component part. Accordingly, in addition to the advantages of the speaker system of the first embodiment, the air permeability of the periphery of the second component part is maintained, and there is the advantageous result that it is possible to reduce the design burden of taking into account the heat resistance of the second component part with respect to the heat generated by the voice coil unit.

In accordance with the speaker system of a fourth preferred embodiment, the second component part and the heat radiating fins are connected by the linking arms that extend in a radiating manner. Accordingly, in addition to the advantages of the speaker system of the first embodiment, there is the advantageous result that it is possible to radiate the heat generated by the voice coil unit from the spaces formed between the linking arms while fixing the second component part in a specified position (a position that faces the first component part) independent from the voice coil unit.

In addition, since the heat radiating fins radiate the heat generated by the voice coil unit, there is the advantageous result that it is possible to reduce the transmission of the heat generated by the voice coil unit to the second component unit via the heat radiating fins and the linking arms.

In accordance with the speaker system of a fifth preferred embodiment, the light receiving element may also be attached to the voice coil unit instead of the reflecting member, and therefore the light radiated by the light emitting element is received directly by the light receiving element. However, in those cases where the reflecting member and the light receiving element have been compared, the reflecting member is generally lighter in weight than the light receiving element. Therefore, there is the advantageous result that it is possible to minimize the changes to the original oscillating action of the voice coil unit and changes to the audio characteristics due to the weight of the reflecting member by linking the reflecting member to the voice coil unit.

In addition, since the air permeability is maintained around the periphery of the reflecting member (the first component part), the requirements related to the heat resistance property of the reflecting member are mitigated. Therefore, there is no need to construct the reflecting member with a metal material, which is superior in heat resistance but heavy in weight, or a functional resin that is relatively high in cost (for example, engineering plastic), and the like. It is possible to construct the reflecting member using a general use plastic resin that is relatively light in weight and low in cost. One example of such a material is ABS (acrylonitrile butadiene styrene). Accordingly, there is the advantageous result that it is possible to minimize the changes to the original oscillating action of the voice coil unit due to the use of a heavy material and to avoid the high manufacturing costs of the system from the use of high-cost materials.

In addition, since the air permeability is maintained around the periphery of the light sensor (the second component part), it is possible to prevent the occurrence of undesirable effects caused by the heat generated by the voice coil unit, such as changes to the characteristics of the light sensor unit or, in some cases, the destruction of the light sensor unit.

Furthermore, since the light sensor unit, which comprises a light emitting element and a light receiving element, can be mounted and removed from the system as a whole unit, there is the advantageous result that it is possible to improve the maintenance properties compared to the case in which the light emitting element and the light receiving element are separate units. As a single unit, the wiring length that is required for the light emitting unit and the light receiving unit can be reduced.

In accordance with the speaker system of a sixth preferred embodiment, the light emitted by the light emitting element is received directly by the light receiving element. Accordingly, the intensity of the received light is relatively higher compared to the case in which the light radiated by light emitting element is received by the light receiving element through reflection from the reflecting member. As a result of reducing the length of the light path, the effects of light interferences from outside is reduced. Therefore, in addition to the advantages of the speaker system of the first embodiment, there is the advantageous result that it is possible to improve the accuracy of the detection of the oscillation of the voice coil unit even more.

In accordance with the speaker system of a seventh preferred embodiment, the reflecting member may be made from a resin that has been molded in a single unit with the linking members and is configured with at least the portion facing the light sensor unit plated with a mirror surface. Accordingly, in addition to the advantages of the speaker system of the fifth embodiment, there is the advantageous result that the reflecting member is light in weight. The light weight of the reflecting member minimizes the changes to the original oscillating action of the voice coil unit and the resulting changes to the audio characteristics due to the weight of the reflecting member. In addition, there is the advantageous result that it is possible to reduce the number of components and to lower the manufacturing costs.

In accordance with the speaker system of an eighth preferred embodiment, the reflecting member is made of a resin that has been molded in a single unit with the linking members and is configured with an aluminum reflecting plate mounted on at least the portion that faces the light sensor unit. Accordingly, in addition to the advantages of the speaker system of the fifth embodiment, it is possible to use a resin material that cannot be plated with a mirror surface but has high heat resistance or a resin material with which the stability of the mirror surface plating is low.

DETAILED DESCRIPTION OF PREFERRED EMBODIMENTS

Figure 1:
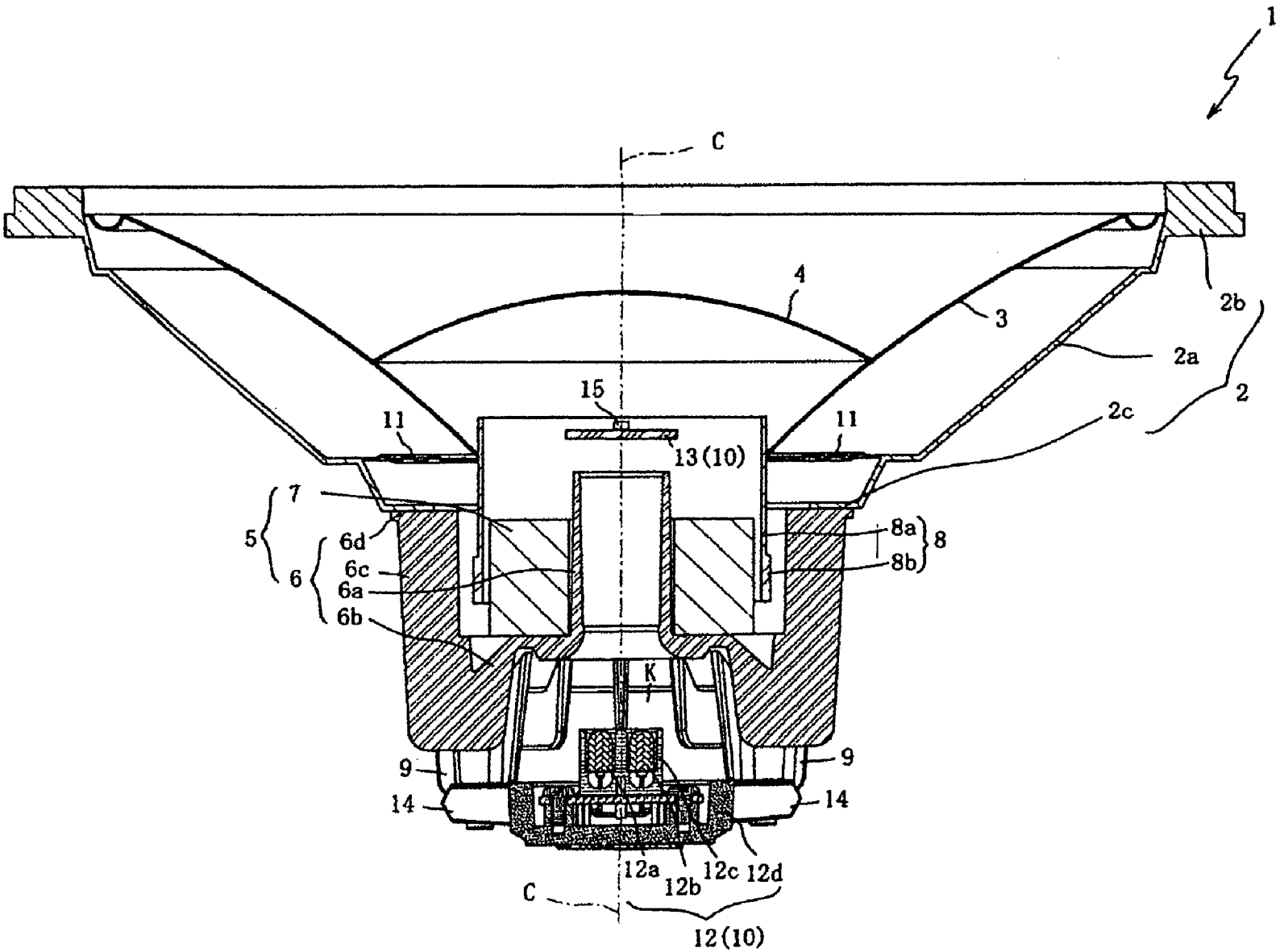
FIG. 1 is a cross-section drawing of a speaker system according to a first preferred embodiment of the present invention.
Figure 2:
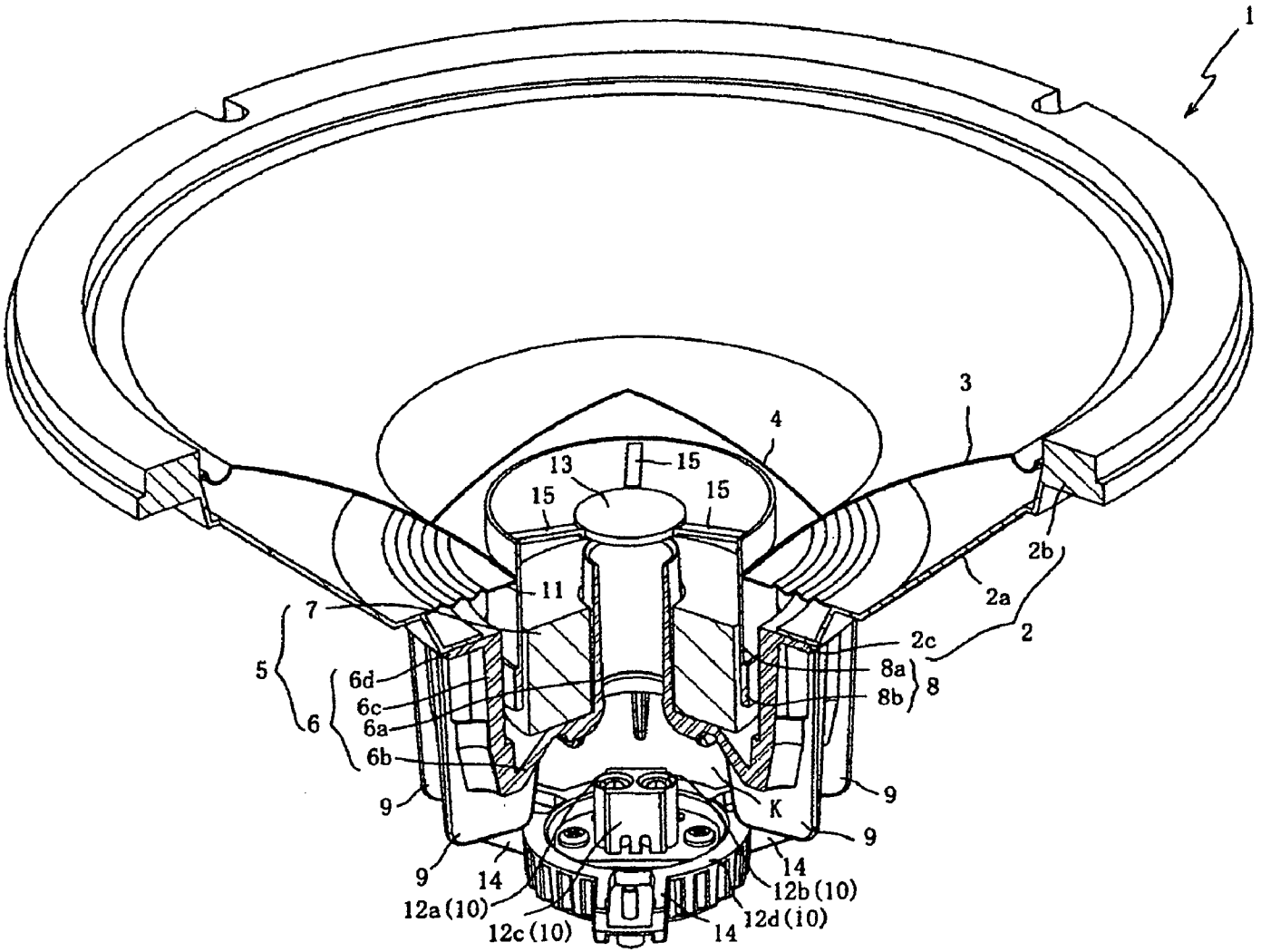
FIG. 2 is a drawing that shows an exterior oblique view of the speaker system according to the first preferred embodiment of the present invention, with a portion cut away.

An explanation will be given below regarding preferred embodiments of the present invention while referring to the attached drawings. First, an explanation will be given regarding a first preferred embodiment of a speaker system of the present invention. FIG. 1 is a cross-section drawing of the speaker system 1 of the first preferred embodiment. FIG. 2 is an oblique external view drawing of the speaker system 1 of the first preferred embodiment and shows a portion of the speaker system 1 in cross-section.

The speaker system 1 is a system capable of detecting the oscillations of the voice coil unit 8 with a high degree of accuracy to produce a high fidelity reproduction. As is shown in FIG. 1, the speaker system 1 primarily comprises a frame 2, a cone 3, a dust cap 4, a magnetic circuit 5, a voice coil unit 8, heat radiating fins 9, and a detection unit 10.

The frame 2 supports the cone 3 and the like. The frame 2 comprises a main body frame 2*a*, a first flange 2*b*, and a second flange 2*c*. The main body frame 2*a* is formed in a conical shape (see FIG. 2) with a diameter that expands toward the front (see the top in FIG. 1; the same hereinafter). The first flange 2*b* protrudes toward the outside from a front edge of the main body frame 2*a*. The second flange 2*c* protrudes toward the inside from a rear edge of the main body frame 2*a*.

The cone 3 functions as an oscillating plate that radiates sound waves by causing the air to vibrate. The cone may be made of paper and is formed in roughly a conical shape (see FIG. 2), the diameter of which expands toward the front and a specified space is left open between the cone and the main body frame 2*a*. In addition, the front end of the cone 3 is attached to the first flange 2*b* of the frame 2, and the rear end of the cone 3 is attached to the outer peripheral surface of the voice bobbin 8*a* that is part of the voice coil unit 8. The cone 3 and the voice bobbin 8*a* together are attached to the main body frame 2*a* through a damper 11.

The dust cap 4 functions as an oscillating plate that radiates sound waves in the same manner as the cone 3. The dust cap 4 prevents the infiltration of dust or dirt, and the like, into the voice coil unit 8 from the outside. The dust cap 4 is formed roughly in a hemispherical shape and is attached to the outer surface of the cone 3 such that the dust cap covers an open face of the voice coil unit 8 that is exposed to the outside from the center portion of the cone 3.

The magnetic circuit 5 generates a magnetic field for the oscillation of the voice coil 8 and comprises the yoke 6 and the magnet 7. The yoke 6 is configured with a ferromagnetic body and comprises the center yoke 6*a*, the bottom yoke 6*b*, side yoke 6*c*, and top yoke 6*d*. The center yoke 6*a* is cylindrically shaped, and is disposed coaxially along a center axis C of the voice coil unit 8. The bottom yoke 6*b* extends toward the outside from the rear end of the center yoke 6*a*. The side yoke 6*c* is disposed surrounding the voice coil unit 8 from the end of the bottom yoke 6*b*. The top yoke 6*d* extends toward the outside from the front end of the side yoke 6*c*. In addition, the top yoke 6*d* is attached to the second flange 2*c* of the frame 2 and the yoke 6 is thus supported by the frame 2.

The magnet 7 is formed in a ring shape that surrounds the center yoke 6*a* between the center yoke 6*a* and the voice bobbin 8*a* and is supported by the bottom yoke 6*b*. In other words, the speaker system 1 in the first preferred embodiment of the present invention is known as an internal magnet type speaker system, in which the magnet 7 is arranged inside the voice coil unit 8 (the voice bobbin 8*a*). However, the speaker system of other embodiments of the present invention may also be an external magnet type speaker system, with which the magnet is arranged on the outside of the voice coil unit 8 (the voice bobbin 8*a*).

The voice coil unit 8 causes the cone 3 (and the dust cap 4) to oscillate, and comprises a cylindrical shaped voice bobbin 8*a* and a voice coil 8*b* wound around the outer peripheral surface of the voice bobbin 8*a*. The voice bobbin 8*a* is arranged between the magnet 7 and the side yoke 6*c* so that back and forth oscillation is possible in the front to back direction (the up and down direction in FIG. 1). The voice coil 8*b* is wound around the area of the outer peripheral surface of the voice bobbin 8*a* in a position that is opposite the magnet 7, and one end is connected to an amplifier that is not shown in the drawings.

When an electrical current is supplied to the voice coil 8*b* in accordance with the electrical power supplied from an amplifier, an electromagnetic force (a Lorenz force) is generated due to the effect of the magnetic field formed by the magnetic circuit 5. Accordingly, the voice coil unit 8 oscillates from front to back in accordance with the electromagnetic force. In this manner, when the voice coil unit 8 oscillates, the cone 3, which is connected to the voice coil unit 8, and the dust cap 4, which is connected to the cone 3, both oscillate together with the oscillation of the voice coil unit 8. The oscillations by the cone 3 and the dust cap 4 cause surrounding air to oscillate and thus a sound wave is radiated.

The heat radiating fins 9 radiate the heat produced by the voice coil 8*b* and comprise a plurality of fins that extend in a radial manner from the periphery of the side yoke 6*c*. When an electrical current is supplied to the voice coil 8*b*, the voice coil 8*b* generates heat and this heat is radiated to the outside by the heat radiating fins 9.

The detection unit 10 optically detects the oscillation of the voice coil unit 8 by detecting the displacement of the oscillation system that comprises the cone 3, the dust cap 4, and the voice coil unit 8. The detection unit 10 comprises a light sensor unit 12, which is positioned with a specified space left open on the center axis C of the voice coil unit 8, and a reflecting member 13.

The detection results of the detection unit 10 is used to generate a negative feedback, which is based on the difference between the input signal and the detected actual oscillation. The negative feedback can be used to offset of the error of the oscillation system with respect to the input signal. Therefore, it is possible to produce a high fidelity reproduction by means of detecting the displacement of the voice coil unit 8 (the displacement of oscillation system) with a relatively high degree of accuracy.

The light sensor unit 12 comprises a light emitting element (a light emitting diode) 12*a*, a light receiving element (a phototransistor) 12*b*, a holder 12*c*, and a support base 12*d*. The light emitting element 12*a* is the light source that radiates light. The light receiving element 12*b* is aligned with the light emitting element 12*a* and receives the light radiated from the light emitting element 12*a*. The holder 12*c* supports the light emitting element 12*a* and the light receiving element 12*b*, and the support base 12*d* supports the holder 12*c*.

The support base 12*d* is positioned on the periphery of the light emitting element 12*a* and the light receiving element 12*b* further back than the bottom yoke 6*b* such that a communicating space K that communicates with the outside space is formed. In addition, the support base 12*d* is supported by three first linking arms 14 that extend in a radial manner from the support base 12*d* and that are linked to the rear end of the heat radiating fins 9 (see FIG. 2).

Therefore, it is possible to position the light sensor unit 12 on the center axis C of the voice coil unit 8 (in a position that is opposite the reflecting member 13) independent of the voice coil unit 8. In addition, the heat produced by the voice coil 8*b* is radiated to the outside via the space that is formed between the first linking arms 14 before the heat is transmitted to the light sensor unit 12. Accordingly, it is possible to limit the transmission of the heat produced by the voice coil 8*b* to the light sensor unit 12, and therefore minimize the occurrence of undesirable effects such as changes to the characteristics or the destruction of the light sensor 12 caused by heat. In addition, since the heat produced by the voice coil 8*b* is radiated by the heat radiating fins 9, it is possible to limit the transmission of the heat produced by the voice coil 8 to the light emitting element 12*a* and the like through the heat radiating fins 9, the first linking arms 14, and the support base 12*d*.

The reflecting member 13 is formed as a roughly circular plate positioned opposite the light sensor unit 12 and is configured with the surface facing the light sensor unit 12 plated with a mirror surface. In addition, the reflecting member 13 is linked to the voice coil unit 8 through three second linking arms 15 (see FIG. 2) that extend in a radial manner from the reflecting member 13 toward the voice coil unit 8.

The three second linking arms 15 are disposed at roughly equal intervals. The ends of the second linking arms opposite to the ends connected to the reflecting member 13 are connected to a portion of the voice coil unit 8 that is the most distant from the voice coil 8*b* (the front end of the voice bobbin 8*a*), which is the heat generating source of the voice coil unit 8. In addition, the three second linking arms 15 and the roughly circular plate portion of the reflecting member 13 may be molded in a single unit using resin. It is possible to employ a general use thermoplastic resin such as, but not limited to, ABS (acrylonitrile butadiene styrene).

The reflecting member 13 is positioned along the center axis C of the voice coil unit 8 and the second linking arms 15 (linking the reflecting member 13 to the voice coil unit 8) are disposed radiating from the center axis C. Therefore, even though the reflecting member 13 is linked to the voice coil unit 8, the weight imbalance of the voice coil unit 8 (with respect to the center axis C) caused by the additional weight of the reflecting member 13 can be minimized.

In addition, since there are spaces between the three second linking arms 15, the air permeation properties are maintained for the periphery of the reflecting member 13 by these spaces. Accordingly, the heat resistance property requirements of the reflecting member 13 are mitigated. Therefore, there is no need to construct the reflecting member 13 with a metal, which is superior in heat resistance but is heavy. Likewise, there is no need to use a high-cost functional resin (for example, engineering plastic) and the like. It is possible to construct the reflecting member 13 with a light-weight and, moreover, low-cost general use thermoplastic resin such as, for example, ABS (acrylonitrile butadiene styrene) and the like. Accordingly, it is possible to limit the change to the oscillation action of the voice coil unit 8 of previous designs due to the use of heavy materials and the increased manufacturing cost associated with the use of high-cost materials.

Furthermore, since the reflecting member 13 is made of a resin molded as a single unit with the second linking arms 15 and is configured such that the portion facing the light sensor unit 12 is plated with a mirror surface, the weight of the reflecting member 13 is made relatively light. The light weight limits the changes to the oscillation action and the changes to the audio characteristics of the voice coil unit caused by the weight of the reflecting member 13 in previous designs. In addition, the number of components is reduced, and therefore it is possible to lower the manufacturing costs.

The reflecting member 13 can also be configured without the portion facing the light sensor unit 12 plated with a mirror surface, but rather with an aluminum reflecting plate mounted on the same portion. In this manner, even if a high heat resistance resin material is used that cannot be plated with a mirror surface, or a resin for which the stability of the mirror surface plating is low, it is possible to produce a reflecting member with satisfactory performance.

In a detection unit 10 configured in this manner (with the reflecting member 13 linked to the voice coil unit 8 via the second linking arms 15), the reflecting member 13 oscillates together with the oscillation of the voice coil unit 8. This oscillation changes the distance between the reflecting member 13 and the light sensor unit 12. By detecting the changes in the distance using the light from the light emitting element 12*a* received by the light receiving element 12*b* after reflecting from the reflecting member 13, the oscillation and displacement of the voice coil unit 8 and, by extension, the oscillation system including the cone 3 and the dust cap 4, can be detected.

As explained above, in accordance with the speaker system 1 of the first preferred embodiment, since the reflecting member 13 is linked to the voice coil unit 8 via the second linking arms 15, the reflecting member 13 oscillates as a single unit with the voice coil unit 8. On the other hand, since the light sensor unit 12 is independent of the voice coil unit 8 and is positioned opposite the reflecting member 13, it is possible to detect the oscillation of the voice coil unit 8 by means of the light that courses between the reflecting member 13 and the light sensor 12, without being affected by the mechanical flexion and the sympathetic vibrations of the dust cap 4.

In addition, even though the reflecting member 13 is attached to the voice coil unit, since the reflecting member 13 and the light sensor 12 are arranged along the center axis C of the voice coil unit 8, the imbalance of the weight distribution of the voice coil unit 8 (with respect to the center axis C of the voice coil unit 8) is limited. Therefore, it is possible to detect the piston motion that is the original oscillating action of the voice coil unit 8 with a relatively high degree of accuracy.

In this manner, since the oscillation and displacement of the oscillation system comprising the voice coil unit 8, the cone 3, and the dust cap 4 are detected, it is possible to detect the oscillation of the voice coil 8, the source of the oscillation of the oscillation system, with a relatively high degree of accuracy. Thus, a high fidelity reproduction can be achieved.

In addition, it is also possible to configure the detection unit 19 such that the light receiving element 12*b* is connected to the voice coil unit 8 rather than the reflecting member 13 and have the light radiated from the light emitting element 12*a* received directly by the light receiving element 12*b*. However, when the reflecting member 13 and the light receiving element 12*b* are compared, the reflecting member 13 is generally lighter in weight than the light receiving element 12*b*. Therefore, by having the reflecting member 13 linked to the voice coil unit 8, it is possible to limit the changes to the original oscillation of the voice coil unit 8 and thus limit the changes to the audio characteristics due to the weight of the reflecting member 13.

Furthermore, since it is possible to mount and remove the light emitting element 12*a*, the light receiving element 12*b*, and the holder 12*c* as a single unit from the speaker system 1, the maintenance properties can be improved compared to the case in which the light emitting element 12*a* and the light receiving element 12*b* are separate units. In addition, it is possible to reduce the length of the wiring needed for the light emitting element 12*a* and the light receiving element 12*b*.

Figure 3:
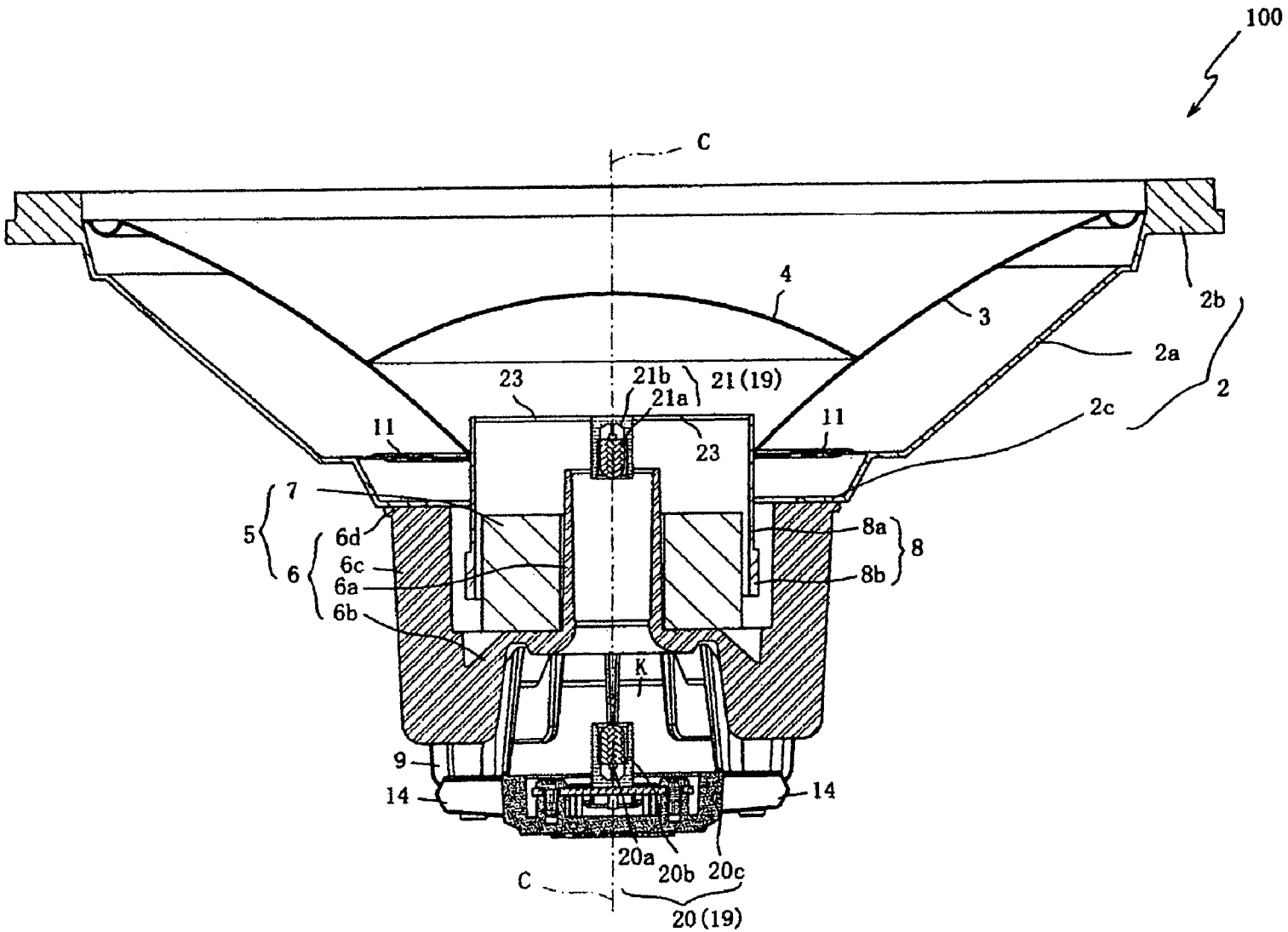
FIG. 3 is a cross-section drawing of a speaker system according to a second preferred embodiment of the present invention.

FIG. 3 is a cross-section drawing of a speaker system 100 of a second preferred embodiment. With regard to the speaker system 100 of the second preferred embodiment, the same keys assigned to structures in common with the speaker system 1 of the first preferred embodiment and their corresponding explanations are omitted.

In contrast to the speaker system 1 of the first preferred embodiment described above that comprises the reflecting member 13 as a major structural element of the detection unit 10, the speaker system 100 of the second preferred embodiment has a detection unit 19 without a reflecting member 13. The speaker system 100 of the second preferred embodiment comprises a light emitting element unit 20 and a light receiving element unit 21 arranged along the center axis C of the voice coil unit 8 with a specified spacing between them as the detection unit 19.

The light emitting element unit 20 comprises a light emitting element (a light emitting diode) 20*a* as the light source that radiates the light, a holder 20*b* that supports a light emitting element 20*a*, and a support base 20*c* that supports a holder 20*b*. The support base 20*c* is supported by the first linking arms 14.

The light receiving element unit 21 comprises a light receiving element (a phototransistor) 21*a* that receives the light radiated from the light emitting element 20*a*, and a holder 21*b* that supports the light receiving element 21*a*. The light receiving element unit 21 is supported by the third linking arms 23 that extend in a radial manner from the holder 21*b* toward the voice bobbin 8*a* and connect the holder 21*b* to the voice bobbin 8*a*.

For the detection unit 19, the light receiving element unit 21 is linked to the voice coil unit 8 via the third linking arms 23. Accordingly, the light receiving element unit 21 oscillates together with the oscillation of the voice coil unit 8. As a result, the distance between the light receiving element unit 21 and the light emitting element unit 20 changes during the oscillation. The changes in the distance is detected by means of the light radiated from the light emitting element 20*a* and received by the light receiving element 21*a*. Therefore, the oscillation and displacement of the voice coil unit 8 and, by extension, the oscillation of the oscillation system including the cone 3 and the dust cap 4, can be detected.

In this manner, since in accordance with the speaker system 100 of the second preferred embodiment, the light receiving element unit 21 is linked to the voice coil unit 8 via the third linking arms 23, the light receiving element unit 21 oscillates in a unified manner with the voice coil unit 8. On the other hand, since the light emitting element unit 20 is independent of the voice coil unit 8 and is arranged facing the light receiving element unit 20, it is possible to detect the oscillation of the voice coil unit 8 by means of the light that courses between the light emitting element unit 20 and the light receiving element unit 21 without being affected by the mechanical flexion and sympathetic vibration of the dust cap 4.

In addition, even though the light receiving element unit 21 is connected to the voice coil unit 8, since the light emitting element unit 20 and the light receiving element unit 21 are positioned on the center axis C of the voice coil unit 8, the weight distribution imbalance of the voice coil unit 8 (with respect to the center axis C of the voice coil unit 8) is limited. Therefore, it is possible to detect the original oscillation action of the voice coil unit 8 with a relatively high degree of accuracy.

In those cases where the oscillation and displacement of the oscillation unit comprising the voice coil unit 8, the cone 3, and the dust cap 4 are detected in this manner, since it is possible to detect the oscillation of the voice coil unit 8, the source of the oscillation of the oscillation system, with a relatively high degree of accuracy, a high fidelity reproduction can be achieved.

In addition, since the light radiated from the light emitting element 20*a* is received directly by the light receiving element 21*a*, the light path is shorter compared to the case where the light radiated from the light emitting element 12*a* is received by the light receiving element 12*b* through the reflecting member 13 (for example, as explained in the first preferred embodiment). The shorter light path increases the intensity of the received light and reduces the effects of interfering outside light. Therefore, it is possible to further improve the accuracy of the detection of the oscillation of the voice coil unit 8.

For the speaker system 1 described above, the reflecting member 13 may be formed in a roughly circular plate shape. However, in other embodiments, the reflecting member 13 may be configured in a roughly hemispherical shape so as to protrude toward the dust cap 4, with the portion facing the light sensor unit 12 plated with a mirror surface. In this case, the light focusing properties can be improved and it is possible to increase the detection accuracy of the detection unit 10.

In addition, the reflecting member 13 of the speaker system 1 described above may be connected to the voice coil unit 8. In other embodiments, the arrangement of the reflecting member 13 and the light sensor unit 12 may be reversed. In the same manner, for the speaker system 100 with the light receiving element unit 21 connected to the voice coil unit 8, the arrangement of the light emitting element unit 20 and the light receiving element unit 21 may also be reversed.

What is claimed is:

1. A speaker system comprising:

a magnetic circuit;

a cylindrical shaped voice coil unit generating oscillation in the magnetic circuit;

an oscillating plate extending in a circular conical shape from a outer peripheral surface of the voice coil unit, a dust cap connecting to the oscillating plate covering an open face of the voice coil unit on a side surrounded by the oscillating plate;

a plurality of linking members connecting to the voice coil unit, each of said linking members extending toward a center axis of the voice coil unit; and a detection unit comprising:

a first component part fastened to the linking members, said first component part positioned at the center axis of the voice coil unit closer to the voice coil unit than the dust cap; and, a second component part positioned facing the first component part, said second component part is independent of the voice coil unit such that the first component part is held between the second component part and the dust cap;

wherein the detection unit optically detects the oscillations of the voice coil unit by means of a light that courses between the first component part and the second component part.

2. The speaker system according to claim 1, wherein the linking members extend in a radial manner from the first component part toward the voice coil unit and connect the first component part to the voice coil unit.

3. The speaker system according to claim 1, further comprising a communicating space that is in communication with a outside space, wherein the communicating space is located in an area around the second component part.

4. The speaker system according to claim 1, further comprising:

a plurality of heat radiating fins, each heat radiating fin extending in a radial manner from an area around the magnetic circuit; and, a plurality of linking arms, each linking arm extending in a radial manner from the second component part toward the heat radiating fins and connect the second component part to the heat radiating fins.

5. The speaker system according to claim 1, wherein the first component part comprises one of either a light sensor unit or a reflecting member, and the second component part comprises the other one of the light sensor unit or the reflecting member not comprised by the first component part;

wherein the light sensor unit further comprises a light emitting element that radiates light, and a light receiving element arranged lined up with the light emitting element that receives the light radiated from the light emitting element; and, wherein the reflecting member reflects the light radiated from the light emitting element toward the light receiving element.

6. The speaker system according to claim 1, wherein:

the first component part comprises either one of a light emitting element unit comprising a light emitting element radiating a light, or a light receiving element unit comprising a light receiving element receiving the light radiated by the light emitting element; and, the second component part comprises either the light emitting element unit or the light receiving element unit not comprised by the first component part.

7. The speaker system according to claim 5, wherein the reflecting member comprises a resin molded as a single unit with the linking members, said reflecting member configured with at least a portion of the reflecting member that faces the light sensor unit plated with a mirror surface.

8. The speaker system according to claim 5, wherein the reflecting member comprises a resin molded as a single unit with the linking members, said reflecting member configured with an aluminum reflecting plate affixed to at least a portion of the reflecting member facing the light sensor unit.

9. A speaker system comprising:

a magnetic circuit generating a magnetic field;

a shaped voice coil unit that oscillates in response to the magnetic field;

a conically shaped oscillating plate with a first opening and a second opening, wherein the first opening is larger than the second opening, and the second opening connects to the voice coil unit;

a dust cap connecting to the oscillating plate covering the second opening of the oscillating plate;

a detection unit for detecting oscillations of the voice coil unit;

wherein the detection unit further comprises a first component connected to a top end of the voice coil unit, and a second component independent from the voice coil unit; and wherein the detection unit detects the oscillations of the voice coil unit through detecting a light signal coursing between the first component and the second component.

10. The speaker system according to claim 9, wherein the voice coil unit is cylindrically shaped, and the first component and the second component are both positioned along a center axis of the cylindrically shaped voice coil unit.

11. The speaker system according to claim 9, wherein the first component is one of either a light sensor unit or a reflecting unit, and the second component is the other of the light sensor unit or the reflecting unit not comprised by the first component.

12. The speaker system according to claim 11, wherein the light sensor unit further comprises a light emitting element and a light sensing element, said light emitting element emits the light signal that courses between the first component and the second component, and said light sensing element detects the light signal after reflection by the reflecting member.

13. The speaker system according to claim 9, wherein the first component is one of either a light sensing unit or a light emitting unit, and the second component is the other of the light sensing unit or the light emitting unit.

14. The speaker system according to claim 9, wherein the first component is connected to the top end of the voice coil unit through a plurality of first linking arms, wherein the first linking arms are spaced apart such that airflow between the first linking arms is possible.

15. The speaker system according to claim 14, wherein each of the plurality of first linking arms radiate from the first component to the top side of the voice coil unit, each said first linking arm is spaced equally apart from neighboring first linking arms.

16. The speaker system according to claim 14, wherein:

the first component is a reflecting unit molded as a single unit with the plurality of linking arms; and, the second component is a light sensor unit comprising a light emitting element and a light receiving element.

17. The speaker system according to claim 16, wherein at least a portion of the reflecting unit is plated with a mirror surface.

18. The speaker system according to claim 16, wherein the single unit of the first component and the plurality of linking arms are molded from a light-weight resin material.

19. The speaker system according to claim 18, wherein the light-weight resin material is acrylonitrile butadiene styrene (ABS).

20. The speaker system according to claim 9, further comprising a plurality of heat radiating fins connected to a frame of the speaker system, said heat radiating fins dissipate heat generated by the voice coil unit.

21. The speaker system according to claim 20, wherein a plurality of second linking arms connects the second component to the heat radiating fins, wherein said second linking arms are spaced apart such that airflow between the second linking arms is possible.

* * * * *